US008840574B2

(12) United States Patent
Ishiguro et al.

(10) Patent No.: US 8,840,574 B2
(45) Date of Patent: Sep. 23, 2014

(54) MASSAGE APPARATUS

(75) Inventors: Fumitaka Ishiguro, Osaka (JP); Bolin Wang, Osaka (JP); Shinsaku Shimizu, Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 804 days.

(21) Appl. No.: 13/128,809

(22) PCT Filed: Oct. 28, 2010

(86) PCT No.: PCT/JP2010/069189

§ 371 (c)(1),
(2), (4) Date: May 11, 2011

(87) PCT Pub. No.: WO2012/049782

PCT Pub. Date: Apr. 19, 2012

(65) Prior Publication Data

US 2012/0095375 A1 Apr. 19, 2012

(30) Foreign Application Priority Data

Oct. 13, 2010 (JP) ..... P2010-230872

(51) Int. Cl.

| | |
|---|---|
| ***A61H 7/00*** | (2006.01) |
| ***A61H 1/00*** | (2006.01) |
| *A61H 15/00* | (2006.01) |

(52) U.S. Cl.

CPC ..... *A61H 7/004* (2013.01); *A61H 2015/0014* (2013.01); *A61H 2201/149* (2013.01); *A61H 2201/1661* (2013.01); *A61H 2205/106* (2013.01); *A61H 2205/12* (2013.01); *A61H 2201/1215* (2013.01); *A61H 2201/1427* (2013.01); *A61H 2201/0192* (2013.01); *A61H 2201/164* (2013.01); *A61H 2201/1695* (2013.01); *A61H 7/007* (2013.01); *A61H 2201/1481* (2013.01); *A61H 2201/1664* (2013.01); *A61H 15/0078* (2013.01)

USPC ..... 601/31; 601/112; 601/53

(58) Field of Classification Search

CPC ..... A61H 1/00; A61H 7/00; A61H 15/00; A61H 2205/10

USPC ..... 601/22, 23, 27–32, 49–51, 53, 85–87, 601/89, 90, 92, 94, 97, 98, 104, 112, 115, 601/134

See application file for complete search history.

(56) References Cited

U.S. PATENT DOCUMENTS 6,196,984 B1 * 3/2001 Hashimoto ..... 601/122

(Continued)

FOREIGN PATENT DOCUMENTS

| | | |
|---|---|---|
| JP | 3372938 B2 | 2/2003 |
| JP | 2003-220105 A | 8/2003 |

(Continued)

*Primary Examiner* — Justine Yu
*Assistant Examiner* — Christopher Miller
(74) *Attorney, Agent, or Firm* — Birch, Stewart, Kolasch & Birch, LLP

(57) ABSTRACT

There is provided a massage apparatus capable of providing optimum massage effects even with variations in thickness of to-be-treated area such as a lower leg from user to user. The massage apparatus 1 includes a massage section 7 having a stationary massage member 15 and a movable massage member 16, a rotary shaft 9, 10 disposed so as to pass through the base end of the movable massage member 16, a driving section 11 for rotatably driving the rotary shaft 9, 10, a pair of right-hand and left-hand changer sections 12, 13 for changing a rotational force of the rotary shaft 9, 19 into an action of movement of the movable massage member 16 toward and away from the stationary massage member 15; and a breadth adjustment mechanism 14 capable of positioning movement of the stationary massage member 15 in directions toward and away from the movable massage member 16.

11 Claims, 5 Drawing Sheets

(56) References Cited

U.S. PATENT DOCUMENTS

| | | | | |
|---|---|---|---|---|
| 7,147,611 | B2 * | 12/2006 | Kassel et al. | 601/90 |
| 7,195,604 | B2 * | 3/2007 | Nakamura et al. | 601/136 |
| 2002/0161316 | A1 | 10/2002 | Shimizu | |
| 2004/0236257 | A1 * | 11/2004 | Hsieh | 601/127 |
| 2006/0149173 | A1 * | 7/2006 | Hsieh | 601/90 |
| 2007/0021694 | A1 | 1/2007 | Shiraishi | |
| 2008/0103420 | A1 * | 5/2008 | Ishiguro et al. | 601/90 |
| 2011/0184324 | A1 * | 7/2011 | Wu et al. | 601/112 |

FOREIGN PATENT DOCUMENTS

| | | | |
|---|---|---|---|
| JP | 2006-026152 | A | 2/2006 |
| JP | 2006-296567 | A | 11/2006 |
| JP | 3861541 | B2 | 12/2006 |
| JP | 4201611 | B2 | 12/2008 |
| JP | 4350278 | B2 | 10/2009 |
| JP | 2010-213777 | A | 9/2010 |
| JP | 4563744 | B2 | 10/2010 |
| WO | WO 01/76527 | A1 | 10/2001 |
| WO | WO 2005/023169 | A1 | 3/2005 |

* cited by examiner

MASSAGE APPARATUS

TECHNICAL FIELD

The present invention relates to a massage apparatus capable of massaging the leg and so forth of a user satisfactorily.

BACKGROUND ART

A heretofore known example of leg massage apparatuses for massaging legs, for example calves and feet, is disclosed in Patent Literature 1.

The massage apparatus presented in Patent Literature 1 is designed to have a pair of kneading means arranged side by side in a horizontal direction, of which each comprises a pair of platy right-hand and left-hand massage members.

In each of the right-hand and left-hand kneading means, the paired right-hand and left-hand massage members are provided to massage a leg, and they are arranged inclined in opposite directions relative to the direction of length of the leg. Moreover, a rotary shaft is disposed, with its axis pointing in the horizontal direction, so as to pass through the right-hand and left-hand massage members. As the rotary shaft is rotated, the massage members repeat a cycle of an action involving mutual approach of their one ends and mutual separation of their other ends and an action involving mutual separation of their one ends and mutual approach of their other ends.

Accordingly, with the leg set in place between the right-hand and left-hand massage members, the massage members act to put pressure on the right side and the left side of the leg along its length repeatedly, thereby allowing the user to have a kneading massage.

PRIOR ART REFERENCE

Patent Literature

Patent Literature 1: International Publication WO 01/76527

SUMMARY OF THE INVENTION

Problems to be Solved by the Invention

In recent years, various requirements have been placed upon conventional massage apparatuses such as disclosed in Patent Literature 1, for example, a cutback in power consumption, structural simplification, and a reduction in the number of constituent components that will eventually result in savings in production costs.

Meanwhile, in a case where a user sets his/her leg in place between the right-hand and left-hand massage members, given that the user has a thin leg (calf, in particular), he/she may be unable to obtain a desired massage effect. By contrast, given that the user has a thick leg, he/she may receive an excessively strong massage force. After all, there has been a demand for a contrivance to render the massage effect consistent regardless of the thickness of the leg of the user.

The present invention has been devised in view of the foregoing circumstances, and accordingly its object is to provide a massage apparatus characterized by satisfying various requirements including a cutback in power consumption, structural simplification, a reduction in the number of constituent components, and savings in production costs without impairment of massage effects, and by providing optimum massage effects for each of users whose to-be-treated body areas such as legs differ in thickness from one another.

Means for Solving the Problems

In order to accomplish the above object, the following technical means is adopted for the implementation of the present invention.

That is, a massage apparatus pursuant to the present invention comprises: a massage section having a stationary massage member and a movable massage member arranged so as to hold a to-be-treated body area in sandwich style; a rotary shaft disposed so as to pass through a base end of the movable massage member of the massage section; a driving section for rotatably driving the rotary shaft; a pair of right-hand and left-hand changer sections for changing a rotational force exerted by the rotary shaft into an action of movement of the movable massage member toward and away from the stationary massage member; and a breadth adjustment mechanism capable of positioning movement of the stationary massage member in directions toward and away from the movable massage member.

In this way, by constructing one of the massage members of a stationary member, it is possible to reduce the number of components for driving the massage members substantially in half and thereby satisfy requirements such as a cutback in power consumption, structural simplification, a reduction in the number of constituent components, and savings in production costs. It is noted that, even if one of the massage members is constructed of a stationary member, there is no decrease of pressing effects (massage pressure) on a to-be-treated area.

It is noted that, in this specification, where the stationary massage member is concerned, the word "stationary" is taken to mean that the massage member is kept fixed in place during a massage treatment to a lower leg. However, according to the present invention, the stationary massage member is allowed to move in a widthwise direction by the breadth adjustment mechanism, and is thus capable of moving toward and away from the movable massage member along the widthwise direction. In this construction, even if there are variations in thickness of a to-be-treated area (such as a lower leg) from user to user, a lower leg of any thickness can be sandwiched properly, thereby providing a massage with a high degree of effectiveness.

It is preferable that there is disposed a pair of the massage sections arranged side by side in a horizontal direction, that the breadth adjustment mechanism includes a breadth adjustment rotary shaft which is placed with its axis pointing in the horizontal direction and is free to rotate both in a normal direction and a reverse direction, the breadth adjustment rotary shaft passing through the stationary massage member mounted in the right-hand massage section and the stationary massage member mounted in the left-hand massage section while threadedly engaging each of threadedly engagement portions disposed in the stationary massage members, respectively, and that, in terms of screw threading, there is an inverse relationship between the threadedly engagement portion of the stationary massage member disposed in the right-hand massage section and the threadedly engagement portion of the stationary massage member disposed in the left-hand massage section.

Moreover, it is advisable that the stationary massage member is provided with an indicator member for indicating the amounts of travel toward and away from the movable massage member.

A support member is disposed between the stationary massage member and the movable massage member so as to be situated at the side of the base ends of the massage members, for supporting the to-be-treated area, and the support member may be placed out of a range of positioning movement of the stationary massage member, yet placed near the movement range.

It is preferable that the changer section comprises: a rotary boss portion which is secured to an axial midpoint of the rotary shaft and has formed at its edge an endless cam face inclined to the rotary shaft; a housing portion formed in a pierced area of the movable massage member so as to be fitted slidably in the periphery of the rotary boss portion; and a restraining portion for restraining the housing portion from rotating dependently with a rotation of the rotary boss portion.

It is advisable that the rotary shaft passes through the stationary massage member and is retained for free rotation relative to the stationary massage member.

Moreover, it is advisable that there is disposed a pair of the massage sections arranged side by side in the horizontal direction, and, in the paired right-hand and left-hand massage sections, their stationary massage members are arranged on the horizontally inward side of the apparatus, whereas their movable massage members are arranged on the horizontally outward side of the apparatus.

It is also preferable that the stationary massage member and the movable massage member are each made of a plate material which is elastically deformable in a thickness-wise direction.

Given that the to-be-treated area is a lower leg including a foot and a calf, it is preferable that the movable massage member is composed of separate components, namely a lower movable body placed in a position for massaging the foot and an upper movable body placed above the lower movable body for massaging the calf.

It is advisable that the stationary massage member is formed in one-piece structure having a size large enough to put pressure on the lower leg between the foot and calf regions.

It is advisable that the breadth adjustment rotary shaft of the breadth adjustment mechanism is constructed of a unitary shaft body.

Advantageous Effect of the Invention

According to the massage apparatus pursuant to the present invention, it is possible to satisfy various requirements including a cutback in power consumption, structural simplification, a reduction in the number of constituent components, and savings in production costs, as well as to provide optimum massage effects even if there are variations in thickness of to-be-treated area such as a lower leg from user to user.

MODES FOR CARRYING OUT THE INVENTION

Hereinafter, an embodiment of the present invention will be described with reference to the drawings.

Figure 1:
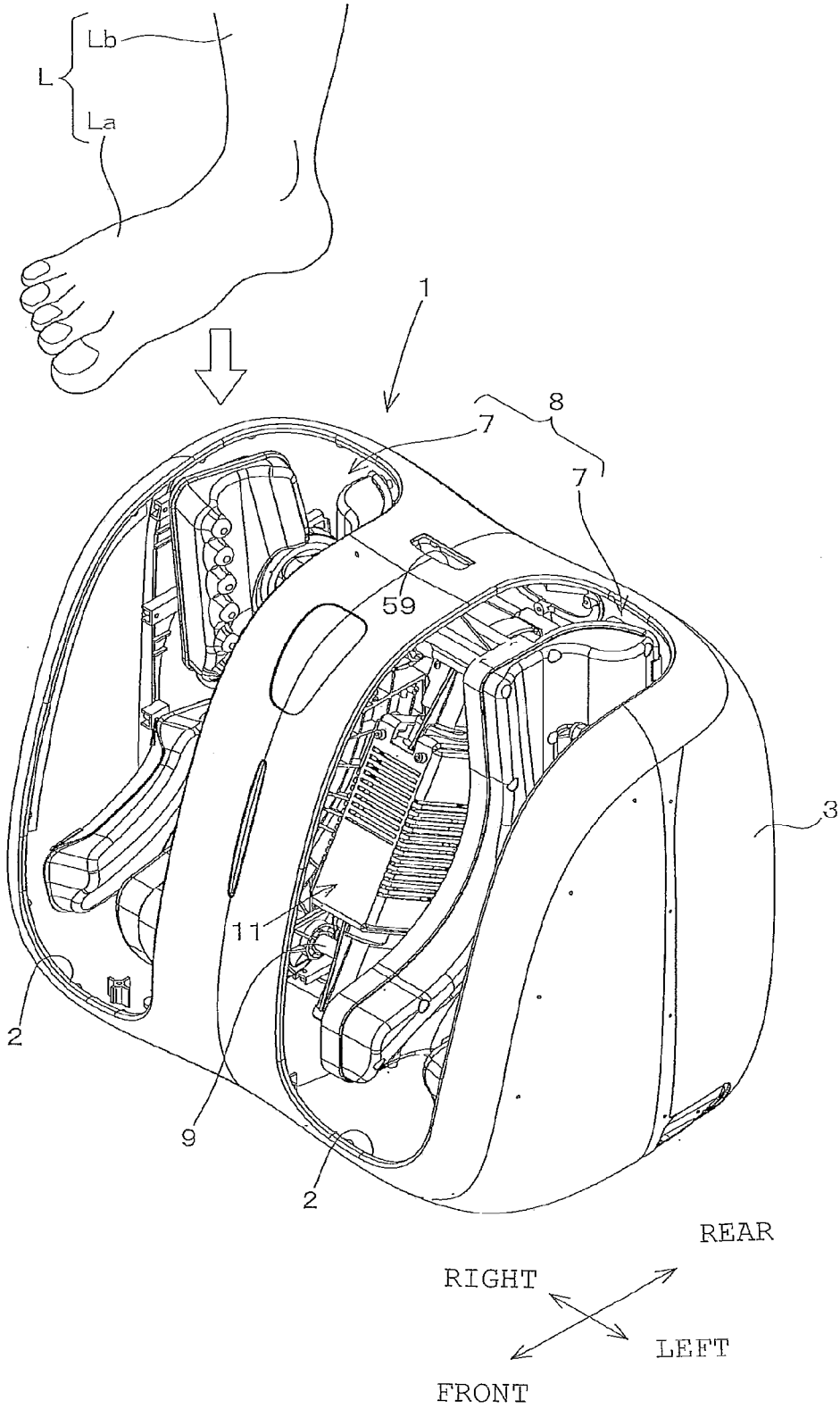
FIG. 1 is a perspective view showing the appearance of a massage apparatus pursuant to the present invention.

In FIGS. 1 to 5, there is shown an embodiment of a massage apparatus 1 pursuant to the present invention. As shown in FIG. 1, in this embodiment, the massage apparatus 1 is designed to give a massage treatment to a lower leg L (foot La and calf Lb) which is a target area to be treated.

In the following description, for convenience in illustrating the present invention, a direction of from right to left (left to right) viewing FIG. 3(B) will be referred to as a right-left, or horizontal direction (widthwise direction) of the apparatus in practice, and a direction perpendicular to the plane of paper sheet with FIG. 3(B) printed on it (a direction of from right to left viewing FIG. 3(A)) will be referred to as a front-rear direction of the apparatus in practice. The horizontal direction and the front-rear direction as employed in the description of the apparatus are indicated by arrows (rightward and leftward arrows, and frontward and rearward arrows) in FIGS. 1 and 2. Moreover, a direction of from top to bottom (bottom to top) viewing FIG. 3(B) will be referred to as a vertical direction in the description of the apparatus.

As shown in FIG. 1, the massage apparatus 1 is covered with a box-shaped casing 3. The casing 3 is formed with two cut-out portions 2 arranged side by side in the horizontal direction. The cut-out portion 2 is a continuous open area extending from the front to the top of the casing 3. The lower leg L of a user can be inserted into each of the right-hand and left-hand cut-out portions 2 and 2, with the direction of length of the calf Lb substantially aligned with the vertical direction and the toe of the foot La pointing forward.

It is noted that, in the apparatus in actuality, it is preferable that a cushion or the like material is placed outside the casing 3 and the cushion-bearing casing 3 is covered with a cover material such as cloth. Moreover, it is advisable that the casing 3 is made of metal or plastic members that can be separated from each other and assembled into a piece in the front-rear direction, for example.

Figure 2:
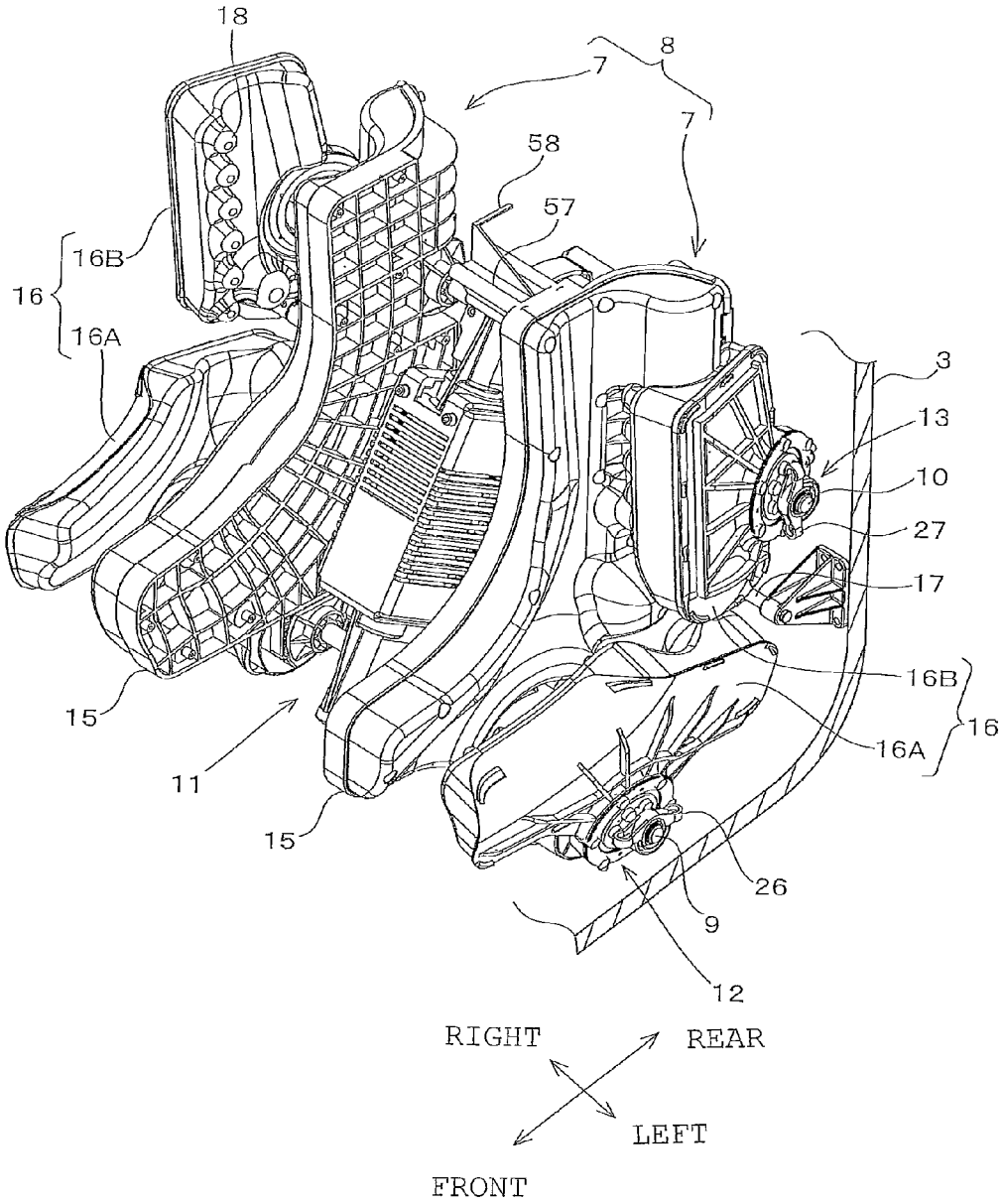
FIG. 2 is a perspective view showing the internal structure of the massage apparatus pursuant to the present invention.
Figure 4:
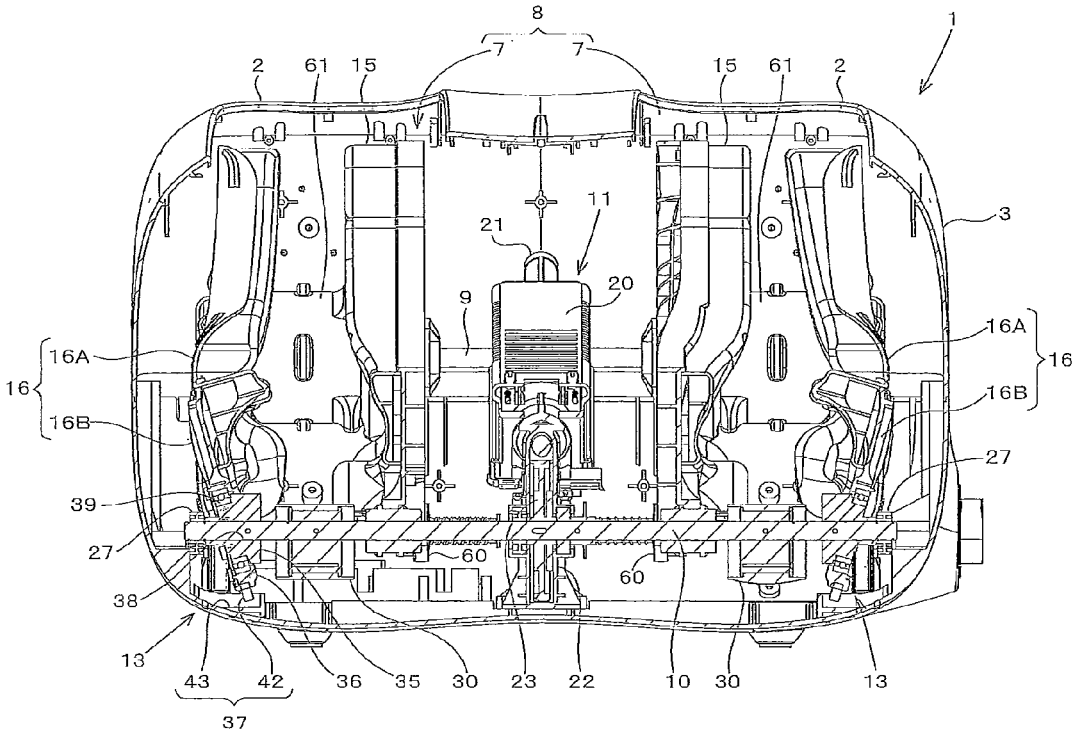
FIG. 4 is a sectional plan view of the massage apparatus pursuant to the present invention (showing the section of the apparatus taken along the position of the axis of the upper rotary shaft).

As shown in FIGS. 2 and 4, inside the casing 3, a right-hand massage section 7 and a left-hand massage section 7 are arranged at a predetermined spacing in the horizontal direction. The right-hand massage section 7 and the left-hand massage section 7 are arranged correspondingly with the right-hand cut-out portion 2 and the left-hand cut-out portion 2, respectively, in the casing 3, thereby constituting a kneading mechanism 8.

Moreover, inside the casing 3, in addition to the kneading mechanism 8, there are disposed: two rotary shafts 9 and 10 passing through the kneading mechanism 8 in the horizontal direction; a driving section 11 for rotatably driving the rotary shafts 9 and 10; and a pair of right-hand and left-hand changer sections for changing a rotation of the rotary shaft 9, 10 into a predetermined massage action at a location where the rotation is transmitted to the right-hand and left-hand massage sections 7 and 7. As the paired right-hand and left-hand changer sections, a pair of changer sections 12 and 12 is provided correspondingly with the rotary shaft 9, and a pair of changer sections 13 and 13 is provided correspondingly with the rotary shaft 10. Further, inside the casing 3, there is disposed a breadth adjustment mechanism 14 to adapt the right-hand and left-hand massage sections 7 and 7 of the kneading mechanism 8 to variations in thickness of the lower leg L (variations in thickness of the calf Lb, variations in width of the foot La) from user to user.

Now, a detailed description will be given below as to the components constituting the massage apparatus 1 of this embodiment.

Firstly, the kneading mechanism 8 comprises the massage sections 7 and 7 arranged correspondingly with the right-hand and left-hand cut-out portions 2 and 2, respectively, formed in the casing 3.

Each massage section 7 comprises a stationary massage member 15 and a movable massage member 16 that are arranged at a predetermined spacing so as to hold the lower leg L in sandwich style. In the paired right-hand and left-hand massage sections 7 and 7, their stationary massage members 15 are arranged close to each other on the horizontally inward side of the apparatus, whereas their movable massage members 16 are arranged apart from each other on the horizontally outward side of the apparatus. In this structure, the lower leg L set in the massage section 7 is sandwiched between the stationary massage member 15 and the movable massage member 16.

The stationary massage member 15 is formed in one piece of a platy member having a size large enough to put pressure on the lower leg L between the foot La and calf Lb regions. That is, the stationary massage member 15 has the shape of a (high) boot when viewed laterally. The stationary massage member 15 is formed of a nylon plate, a leaf spring, or the like, or formed by placing a soft, flexible material on a surface of a member that acts to put pressure on the lower leg L. The stationary massage member 15 thereby constructed is elastically deformable in a thickness-wise direction.

The rotary shaft 9 is disposed in impaled fashion so as to pass through the lower end of the stationary massage member 15, thereby permitting free sliding motion of the stationary massage member 15 in a direction axially of the rotary shaft 9. Moreover, the other rotary shaft 10 is disposed in impaled fashion so as to pass through an upper part of the rear end of the stationary massage member 15, thereby permitting free sliding motion of the stationary massage member 15 in a direction axially of the rotary shaft 10. Further, a breadth adjustment rotary shaft 17 of the breadth adjustment mechanism 14, which will hereafter be described, is disposed in impaled fashion so as to pass through a midportion of the rear end of the stationary massage member 15. The breadth adjustment rotary shaft 17 is disposed in a position midway between the lower-located rotary shaft 9 and the upper-located rotary shaft 10 in the vertical direction, and is situated immediately below the upper rotary shaft 10.

That is, three rotary shafts in total, namely the rotary shafts 9 and 10 and the breadth adjustment rotary shaft 17 pass through the stationary massage member 15 in the horizontal direction. In this way, the stationary massage member 15 is retained in a suspended state at a predetermined level above the inner lower surface of the casing 3.

In contrast to the stationary massage member 15 thereby constructed, the movable massage member 16 comprises a lower movable body 16A and an upper movable body 16B that are provided independently of each other. The lower movable body 16A is placed in a position for massaging the foot La of the lower leg L, and the upper movable body 16B is placed above the lower movable body 16A, for massaging the calf Lb of the lower leg L. The movable massage member 16 (the lower movable body 16A and the upper movable body 16B) is also formed of a nylon plate, a leaf spring, or the like, or formed by placing a soft, flexible material on a surface of a member that acts to put pressure on the lower leg L. The movable massage member 16 thereby constructed is elastically deformable in a thickness-wise direction.

The rotary shaft 9 is disposed in impaled fashion so as to pass through substantially the center of the lower end of the lower movable body 16A in the front-rear direction. Moreover, the rotary shaft 10 is disposed in impaled fashion so as to pass through substantially the center of the rear end of the upper movable body 16B in the vertical direction.

At the lower end of the lower movable body 16A is disposed the changer section 12 (lower changer section 12) for changing a rotational force exerted by the rotary shaft 9 into a massage action (rolling motion) of the lower movable body 16A. The rotary shaft 9 passes through the lower changer section 12, with its axis pointing in the horizontal direction. It is noted that the rotary shaft 9 may occasionally be represented as "the lower rotary shaft 9", and the changer section 12 may occasionally be represented as "the lower changer section 12".

Meanwhile, at the rear end of the upper movable body 16B is disposed the changer section 13 (upper changer section 13) for changing a rotational force exerted by the rotary shaft 10 into a massage action (rolling motion) of the upper movable body 16B. The rotary shaft 10 passes through the upper changer section 13, with its axis pointing in the horizontal direction. It is noted that the rotary shaft 10 may occasionally be represented as "the upper rotary shaft 10", and the changer section 13 may occasionally be represented as "the upper changer section 13".

With the provision of the lower rotary shaft 9 and the upper rotary shaft 10, the lower movable body 16A and the upper movable body 16B of the movable massage member 16 are each retained in a suspended state at a predetermined level above the inner lower surface of the casing 3. Moreover, the breadth adjustment rotary shaft 17 is so placed as to cross a region between the lower movable body 16A and the upper movable body 16B in the vertical direction, and therefore does not pass through the movable massage member 16.

In this embodiment, the upper movable body 16B of the movable massage member 16 has a plurality of pressing projections 18 (refer to FIG. 2) formed on its surface opposed to the stationary massage member 15. With the lower leg L set in place between the stationary massage member 15 and the movable massage member 16, the pressing projections 18 are abutted against the lower leg L (the horizontally outer side of the calf Lb) to give a massage pressure of adequate strength (stimuli) and exert an anti-slippage effect on the lower leg L.

Figure 3:
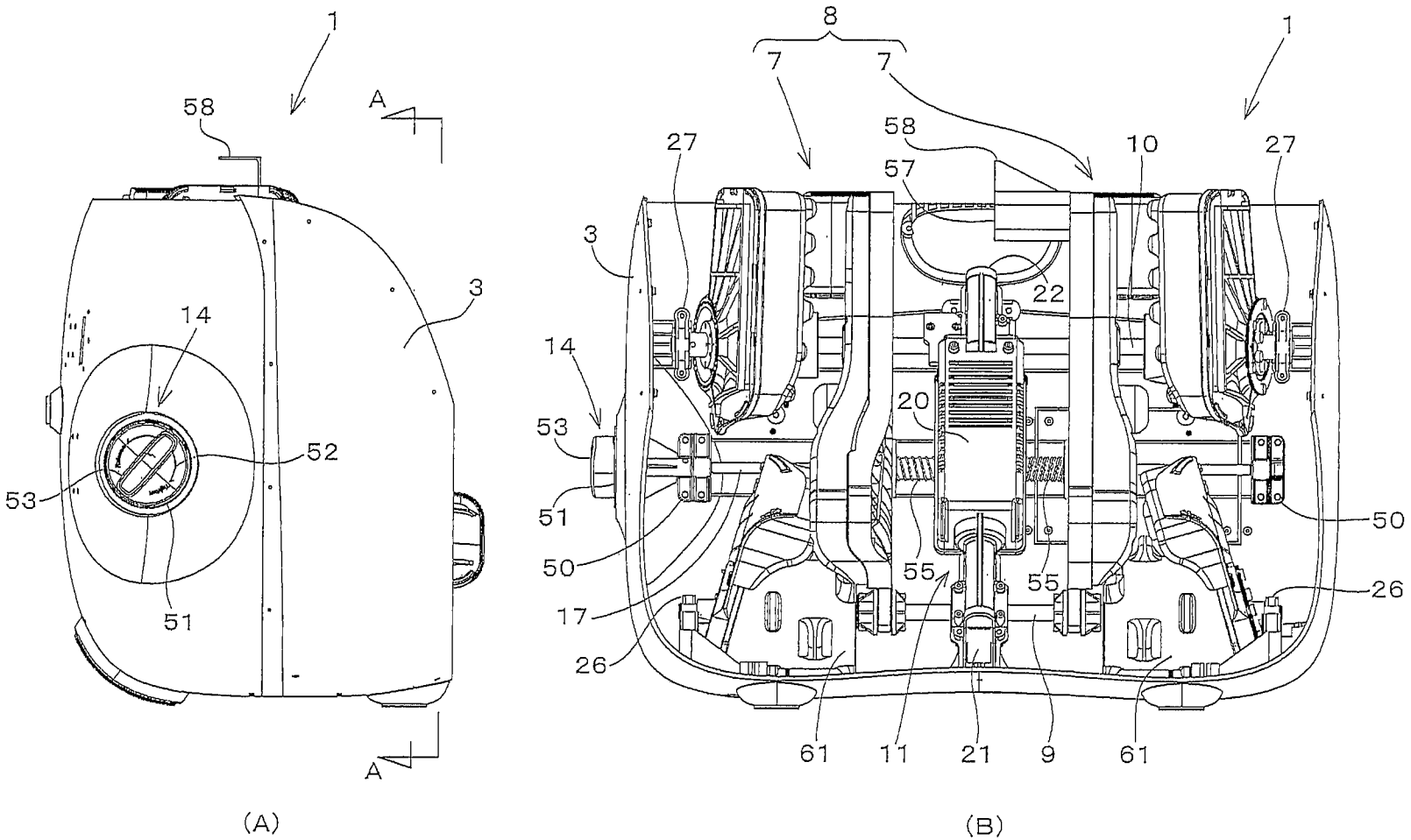
FIG. 3(A) is a side view of the massage apparatus pursuant to the present invention.
FIG. 3(B) is a view taken in the direction of arrows along the line A-A of FIG. 3(A) (a front view showing the internal structure).

Next, the driving section 11 for driving the kneading mechanism 8 will be explained with reference to FIGS. 2 to 4.

The driving section 11 comprises an electric motor 20 of double-shaft type (a motor with drive shafts protruding from both sides of a motor main body) and two speed reducers 21 and 22 connected in association with the drive shafts, respectively, of the electric motor 20.

The electric motor 20 is disposed horizontally centrally of the interior of the casing 3 so as to be situated between the right-hand and left-hand massage sections 7 and 7, the driving shafts of which are located in a vertically-distributed manner. Expressed differently, the electric motor 20 is positioned to be sandwiched between the right-hand and left-hand stationary massage members 15 and 15. The electric motor 20 is so disposed that the upper driving shaft is inclined gradually rearwardly from bottom to top and the lower driving shaft is inclined gradually forwardly from top to bottom.

As shown in FIG. 4, the upper driving shaft of the electric motor 20 is, at its front end, coupled to the speed reducer 22. The speed reducer 22 has a built-in gear mechanism 23 including a worm gear and a worm wheel, for example. The speed of rotational output from the electric motor 20 is reduced by the gear mechanism 23, and the speed reducer 22 is placed with its axis lying orthogonal plane-wise to the driving shaft of the electric motor 20. In this state, the rotational output is transmitted to the upper rotary shaft 10. That is, the upper rotary shaft 10 is disposed in a rotatably supported state so as to extend in the horizontal direction, while passing through the speed reducer 22, toward the opposite sides of the apparatus.

The upper rotary shaft 10 extends beyond the speed reducer 22 toward the horizontally opposite sides, then passes through the right-hand and left-hand massage sections 7 and 7 of the kneading-mechanism 8, more specifically passes through the stationary massage members 15 first and subsequently the upper changer sections 13 of the movable massage members 16 (the upper movable bodies 16B) in the horizontal direction, and is lastly retained, at its horizontally opposite shaft ends, by shaft bearing portions 27. The shaft bearing portion 27 is attached to each of the horizontally opposite ends of the casing 3 as either an integral part or a separate component.

The upper rotary shaft 10 is, at its part running through the stationary massage member 15, retained for free rotation (free sliding motion) relative to the stationary massage member 15. Moreover, the shaft bearing portion 27 has a shaft bearing attachment such as a bearing, and this shaft bearing attachment allows the upper rotary shaft 10 to rotate freely and smoothly. It will thus be seen that the upper rotary shaft 10 has its each end supported across the driving section 11 (speed reducer 22) and the shaft bearing portion 27, and has its part between the supported ends retained by the stationary massage members 15 for keeping its rotation.

On the other hand, the lower driving shaft of the electric motor 20 is, at its front end, coupled to the speed reducer 21. The speed reducer 21 has a built-in mechanism which is substantially the same as that of the upper-located speed reducer 22, and is coupled to the electric motor 20 to drive the lower rotary shaft 9 to rotate. Moreover, the lower rotary shaft 9 extends beyond the speed reducer 21 toward the horizontally opposite sides, then passes through the stationary massage members 15 first and subsequently the lower changer sections 12 of the movable massage members 16 (the lower movable bodies 16A) in the horizontal direction, and is lastly retained, at its horizontally opposite shaft ends, by shaft bearing portions 26. The shaft bearing portion 26 is attached to each of the horizontally opposite ends of the casing 3 interiorly thereof as either an integral part or a separate component.

Moreover, in this embodiment, the upper rotary shaft 10 is provided with support members 30 each situated at the rear of a region between the stationary massage member 15 and the movable massage member 16, for supporting a to-be-treated area (the calf Lb of the lower leg L). The support member 30 is placed out of the range of positioning movement of the stationary massage member 15, yet placed near the movement range.

The support member 30 has the form of a drum which is so shaped that its diameter becomes larger gradually from each end to the center in the horizontal direction, the center of the drum being eccentric with respect to the upper rotary shaft 10. The support member 30 is attached for unitary rotation with the upper rotary shaft 10.

Accordingly, upon the lower leg L being inserted between the stationary massage member 15 and the movable massage member 16, the calf Lb of the lower leg L is abutted against the support member 30. This allows the user to take a comfortable position. Moreover, as the upper rotary shaft 10 is rotated, the support member 30 is caused to rotate eccentrically about the axis of the upper rotary shaft 10, thereby applying a forwardly pressing force to the calf Lb of the lower leg L as a massage effect.

Likewise, the lower rotary shaft 9 is provided with support members 61 each disposed between the stationary massage member 15 and the movable massage member 16 so as to be situated at the side of the base ends of the massage members 15 and 16, for supporting another to-be-treated area (the foot La of the lower leg L). The support member 61 is placed out of the range of positioning movement of the stationary massage member 15, yet placed near the movement range.

The support member 61 is shaped like a drum having a plurality of projections formed in several circumferential and axial positions around its outer peripheral surface. The support member 61 is attached for unitary rotation with the lower rotary shaft 9.

Accordingly, upon the lower leg L being inserted between the stationary massage member 15 and the movable massage member 16, the foot La of the lower leg L can be rested on the support member 61. This allows the user to take a comfortable position. Moreover, as the lower rotary shaft 9 is rotated, the support member 61 is caused to rotate unitarily therewith, and correspondingly the plurality of projections are moved circumferentially, thereby applying an upwardly pressing force like a finger pressure (tapping action) to the foot La of the lower leg L as a massage effect.

Next, a description will be given as to the changer sections (the lower changer section 12 and the upper changer section 13) for changing a rotational force of the rotary shaft 9, 10 into a massage action (rolling motion) of the movable body 16A, 16B.

The upper changer section 13 comprises a rotary boss portion 35, a housing portion 36, and a restraining portion 37. The rotary boss portion 35 is secured to an axial midpoint of the upper rotary shaft 10 (that part of the upper rotary shaft 10 which runs through the upper movable body 16B of the movable massage member 16) for unitary rotation with the upper rotary shaft 10. The housing portion 36 is fitted for free rotation relative to the outer periphery of the rotary boss portion 35. The restraining portion 37 restrains the housing portion 36 from rotating dependently with the rotation of the rotary boss portion 35.

The housing portion 36 is attached to the movable massage member 16 as either an integral part or a separate component.

The rotary boss portion 35 has a shaft hole 38 created in the form of a through hole so as not to be perpendicular to but to be inclined to the end face of the rotary boss portion 35 at a predetermined angle. The upper rotary shaft 10 passes through the shaft hole 38. In this way, the upper rotary shaft 10 and the rotary boss portion 35 can be rotated unitarily. The rotary boss portion 35 has formed at its edge an endless track (cam face) 39 inclined to the upper rotary shaft 10. The axis of the endless track 39 is inclined to the axis of the upper rotary shaft 10.

A bearing is fitted in the endless track 39. The housing portion 36 can be rotated relative to the rotary boss portion 35 via the bearing.

The rotary boss portion 35 at the side of the upper movable body 16B of the movable massage member 16 provided in the right-hand massage section 7 and the other rotary boss portion 35 at the side of the upper movable body 16B of the movable massage member 16 provided in the left-hand massage section 7 are secured to the upper rotary shaft 10, with their shaft holes 38 inclined in opposite directions. Correspondingly, the endless tracks 39 of, respectively, the rotary boss portions 35 are disposed in oppositely inclined relation.

The restraining portion 37 comprises an engagement projection 42 extending toward the inner rear surface of the casing 3 from the housing portion 36 and a slide groove 43 pointing in the horizontal direction in which is slidably fitted the engagement projection 42. It is advisable to form the slide groove 43 by using a pair of upper and lower ribs arranged vertically so as to have sandwiched therebetween a range of horizontal movement of the engagement projection 42 relative to the casing 3 as a guide.

That is, since the engagement projection 42 is allowed to move only in the horizontal direction under restraint by the front and rear parts of the ribs (within the range of slide groove 43), it follows that the movable massage member 16 is restrained from rotating dependently with the rotation of the upper rotary shaft 10. As a result, the rotary boss portion 35 rotating unitarily with the upper rotary shaft 10 is brought into a freewheeling condition relative to the housing portion 36 fitted in the rotary boss portion 35 via the bearing, thereby causing the housing portion 36 to swing horizontally about the upper rotary shaft 10. With such a movement, a horizontal rocking motion is imparted to the upper movable body 16B of the movable massage member 16, and this horizontal rocking motion (the approachable and separable movement, or the movement of the movable massage member 16 toward and away from the stationary massage member 15) brings about a massage action on the calf Lb of the lower leg L.

The mechanism of the lower changer section 12 relative to the lower rotary shaft 9 is substantially the same as the mechanism of the upper changer section 13 relative to the upper rotary shaft. Accordingly, the lower changer section 12 acts to impart a horizontal rocking motion to the lower movable body 16A of the movable massage member 16, and this horizontal rocking motion (the movement of the movable massage member 16 toward and away from the stationary massage member 15) brings about a massage action on the foot La of the lower leg L. It is noted that the structure of the lower changer section 12 is substantially the same as that of the upper changer section 13, and therefore the detailed description thereof will be omitted.

Next, a description will be given as to the breadth adjustment mechanism 14 which constitutes a distinctive feature of the massage apparatus 1 pursuant to the present invention. The breadth adjustment mechanism 14 allows positional adjustment in such a manner that the stationary massage member 15 is moved toward and away from the movable massage member 16 (the lower movable body 16A and the upper movable body 16B).

As shown in FIG. 3(B), the breadth adjustment mechanism 14 includes a single breadth adjustment rotary shaft 17 passing through the stationary massage members 15 of, respectively, the right-hand and left-hand massage sections 7 and 7 in the horizontal direction.

Figure 5:
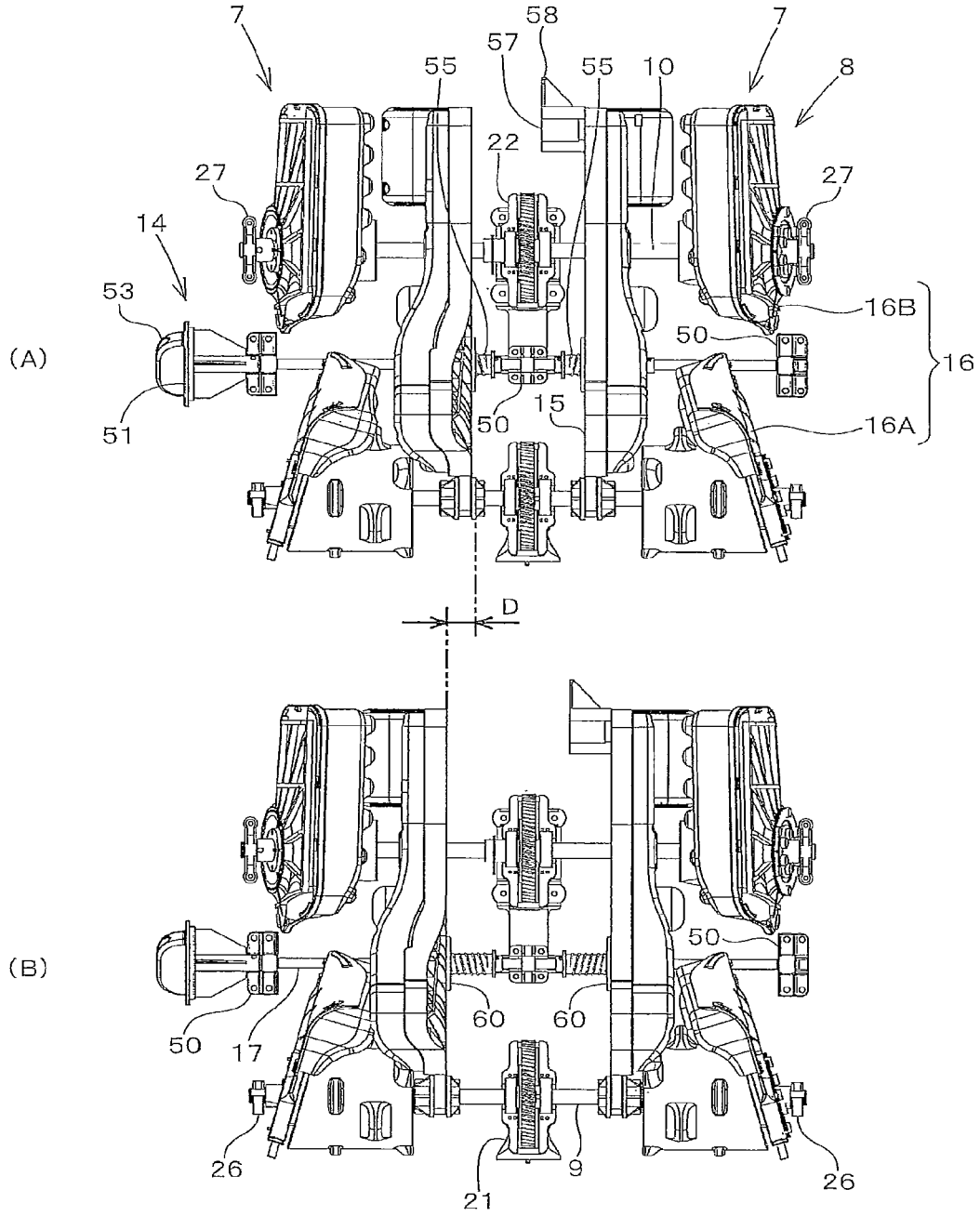
FIG. 5 is an explanatory diagram of the operation of the breadth adjustment mechanism mounted in the massage apparatus pursuant to the present invention, with FIG. 5(A) showing a state where the stationary massage member and the movable massage member are kept away from each other, and FIG. 5(B) showing a state where the stationary massage member and the movable massage member are kept closer to each other.

The breadth adjustment rotary shaft 17 is rotatably retained on the inner rear surface of the casing 3 at its three parts in total, namely a part extending leftward beyond the left-hand stationary massage member 15, a part extending rightward beyond the right-hand stationary massage member 15, and, as shown in FIG. 5, a part extending between the right-hand and left-hand stationary massage members 15 and 15 and situated at the rear of the electric motor 20 (the electric motor 20 is not represented graphically in FIG. 5) via rotation keeping brackets 50, 50, and 50.

In the breadth adjustment rotary shaft 17, an external thread portion 55 is formed in each of that part thereof which runs through the left-hand stationary massage member 15 and that part thereof which runs through the right-hand stationary massage member 15. On the other hand, in each of the right-hand and left-hand stationary massage members 15 and 15, a threadedly engagement portion 60 is formed in that part thereof through which the breadth adjustment rotary shaft 1 runs. The threadedly engagement portion 60 has an internal thread which is threadedly engageable with the external thread portion 55 of the breadth adjustment rotary shaft 17.

In terms of screw threading, an inverse relationship is maintained between the engagement of the threadedly engagement portion 60 of the left-hand stationary massage member 15 with the external thread portion 55 of the breadth adjustment rotary shaft 17 and the engagement of the threadedly engagement portion 60 of the right-hand stationary massage member 15 with the external thread portion 55 of the breadth adjustment rotary shaft 17. Specifically, for example, where the external thread portion 55 at the side of the left-hand stationary massage member is made as a right-hand thread, then the external thread portion 55 at the side of the right-hand stationary massage member is made as a left-hand thread. It is noted that the external thread portions 55 disposed in such a threadedly engagement relation are made identical in outside diameter and lead angle with each other.

Accordingly, as the breadth adjustment rotary shaft 17 is turned in the normal direction, the stationary massage members 15 and 15 are moved closer to their respective opposed movable massage members 16 and 16, whereupon the distance between the members 15 and 16 is decreased (FIG. 5(B)). By contrast, as the breadth adjustment rotary shaft 17 is turned in the reverse direction, the stationary massage members 15 and 15 are moved away from their respective opposed movable massage members 16 and 16, whereupon the distance between the members 15 and 16 is increased (FIG. 5(A)). It seems superfluous to say that such a movement of the stationary massage member 15 (travel D) is in line with a direction axially of the breadth adjustment rotary shaft 17 and is guided by the lower rotary shaft 9 and the upper rotary shaft 10. Moreover, the right-hand and left-hand stationary massage members 15 and 15 are configured to move by the same distance (have the same travel D)

By virtue of the action of the breadth adjustment mechanism 14, even if there are variations in thickness of the to-be-treated area (lower leg) from user to user, a lower leg of any thickness can be sandwiched properly, thereby providing a massage with a high degree of effectiveness.

It is noted that, where the stationary massage member 15 of this embodiment is concerned, the word "stationary" is taken to mean that the massage member is kept fixed in place during a massage treatment to the lower leg L, and this does not subsume a restraint on the widthwise movement of the stationary massage member 15 by the amount of travel D effected by the breadth adjustment mechanism 14.

In this embodiment, the breadth adjustment rotary shaft 17 extends outwardly of one side surface of the casing 3 (extends leftward viewing FIG. 3(B), yet extends rightward as viewed by the user), and this extended end part is, as shown in FIG. 3(A), coupled to an operation dial 51, which is disposed so as to pass through one side surface of the casing 3, for unitary rotation. Accordingly, by turning the operation dial 51, the breadth adjustment rotary shaft 17 can be rotated both in the normal direction and the reverse direction. The operation dial 51 is, at its end face which is visible from the outside of the casing 3, marked with arrows 52 indicative of the directions of rotations of the breadth adjustment rotary shaft 17 in an easy-to-understand manner. Moreover, the operation dial 51 is formed with a pull 53 in the form of a plate protruding along the axial direction of the breadth adjustment rotary shaft 17. This facilitates slippage prevention and fine adjustment to rotation during the operation of the apparatus.

Moreover, one of the stationary massage members 15 is provided with an indicator member 57. In this embodiment, the indicator member 57 is disposed on an outer surface (a surface opposed to the other stationary massage member 15) of the upper end of the stationary massage member 15 situated on the right viewing FIG. 3(B), or the stationary massage member 15 situated on the left as viewed by the user.

The indicator member 57 has a pointer 58 protruding toward the top of the casing 3 and having a rear-facing horizontal bend. On the other hand, as shown in FIG. 1, the casing 3 has formed at its top a confirmation window 59 through which the movement of the pointer 58, in conjunction with the indicator member 57, in response to the positioning movement of the stationary massage member 15 can be visually checked from above.

In this construction, the indicator member 57 (the pointer 58) gives an indication of the amount of mutual approach movement and separation movement of the stationary massage member 15 and the movable massage member 16. It is desirable to form a graded scale or color coding at the edge of the opening of the confirmation window 59 for ease in understanding the travel of the pointer 58.

Newt, how the massage apparatus 1 pursuant to the present invention is to be operated will be described below.

Let it be assumed that, in each of the right-hand and left-hand massage sections 7 and 7, the lower leg L has been inserted into the region between the stationary massage member 15 and the movable massage member 16 and then the electric motor 20 of the driving section 11 was driven to operate.

In this case, as the electric motor 20 runs, the lower rotary shaft 9 is rotated via the lower changer section 12, whereby the lower movable body 16A is operated in such a manner that its front upper end moves gradually closer to the stationary massage member 15, whereas its rear upper end moves gradually away from the stationary massage member 15.

After that, the lower movable body 16A is operated in such a manner that its front upper end moves gradually away from the stationary massage member 15, whereas its rear upper end moves gradually closer to the stationary massage member 15.

In this way, the lower movable body 16A of the movable massage member 16 is rocked to repeat a cycle of a horizontally inward movement of the front upper end; that is, a movement of the front upper end toward the location where the stationary massage member 15 is placed, and a horizontally outward movement of the front upper end; that is, a movement of the front upper end away from the location where the stationary massage member 15 is placed. During this time, in the lower movable body 16A, the front upper end undergoes repetition of a cycle of a downward motion and an upward motion of small extent, thereby producing a spatial rolling motion.

Likewise, as the electric motor 20 runs, the upper rotary shaft 10 is rotated via the upper changer section 13, whereby the upper movable body 16B is operated in such a manner that its upper front end moves gradually closer to the stationary massage member 15, whereas its lower front end moves gradually away from the stationary massage member 15.

After that, the upper movable body 16B is operated in such a manner that its upper front end moves gradually away from the stationary massage member 15, whereas its lower front end moves gradually closer to the stationary massage member 15.

In this way, the upper movable body 16B of the movable massage member 16 is rocked to repeat a cycle of a horizontally inward movement of its upper front end, or a movement of the upper front end toward the location where the stationary massage member 15 is placed, and a horizontally outward movement of its upper front end, or a movement of the upper front end away from the location where the stationary massage member 15 is placed. During this time, in the upper movable body 16B, the upper-front end undergoes repetition of a cycle of a downward motion and an upward motion of small extent, thereby producing a spatial rolling motion.

It seems superfluous to say that, at this time, the stationary massage member 15 is fixed in place and is therefore kept in an immovable state independently of the movement of the movable massage member 16 (the lower movable body 16A and the upper movable body 16B) thus far described.

Moreover, the movable massage member 16 is so designed that the repetitive spatial rolling rocking motion of the lower movable body 16A and that of the upper movable body 16B take place in synchronism with each other.

Thus, the user is able to have the lower leg L massaged in a manner whereby the lower leg L put in each of the right-hand and left-hand massage sections 7 and 7 receives a pressing force at each side in the horizontal direction and subsequently the pressing force is decreased (released) in cycles. That is, a kneading massage is performed on the lower leg L in the direction of its length.

The movable massage member 16 is composed of separate components, namely the lower movable body 16A and the upper movable body 16B. Therefore, in massaging the lower leg L, a massage can be performed on each of the foot La and the calf Lb on an individual basis. This makes it possible to perform adequate massage treatment with consideration given to the shape of the lower leg L and desired pressure points.

Then, let it be assumed that an other person took the user's place and his/her lower leg L of different thickness was inserted into the region between the stationary massage member 15 and the movable massage member 16. In this case, the new user takes hold of the operation dial 51 and the pull 53 formed on the side surface of the casing 3 and makes dial turning operation at will in accordance with the arrows 52 indicative of the directions of widening and narrowing of the region.

Upon turning the operation dial 51, the breadth adjustment rotary shaft 17 is rotated, thus causing the right-hand and left-hand stationary massage members 15 and 15 to move in the direction of mutual approach or separation by the same amount of travel.

For example, as shown in FIG. 5(A), by causing the stationary massage member 15 to move in a direction away from its respective opposed movable massage member 16, the lower leg L of relatively large thickness can be settled in an optimal position. On the other hand, as shown in FIG. 5(B), by causing the stationary massage member 15 to move in a direction closer to its respective opposed movable massage member 16, the lower leg L of relatively small thickness can be settled in an optimal position. It is advisable to turn the operation dial 51 (for adjustment of turning amount and turning direction) on the basis of the position of the pointer 58 which is visible through the confirmation window 59, while considering the extent of pressing force exerted on the lower leg L sandwiched between the stationary massage member 15 and the movable massage member 16.

In this way, even if there are variations in thickness of the lower leg L to be sandwiched between the stationary massage member 15 and the movable massage member 16 from user to user, a pressing force (massage treatment) can be given to the lower leg of any thickness with reliability and optimality.

It should be understood that the embodiments as set forth hereinabove are considered in all respects as illustrative only and not restrictive. The scope of the present invention is indicated by the appended claims rather than the foregoing description, and all changes that come within the meaning of and the range of equivalency of the claims are intended to be embraced therein.

For example, in each of the right-hand and left-hand massage sections 7 and 7 of the kneading mechanism 8, the stationary massage member 15 and the movable massage member 16 may be arranged in the place of each other in the horizontal direction. That is, in the right-hand and left-hand massage sections 7 and 7, their stationary massage members 15 are arranged on the horizontally outward side of the apparatus, whereas their movable massage members 16 are arranged on the horizontally inward side of the apparatus.

Moreover, the movable massage member 16 does not necessarily have to be composed of separate components, namely the lower movable body 16A and the upper movable body 16B, but may be configured to have one of them (designed to massage, of the lower leg L, only the foot La or calf Lb). In another alternative, the lower movable body 16A and the upper movable body 16B may be integrally formed in one piece.

Moreover, the massage apparatus 1 may be implemented by way of a footrest of a chair-type massage apparatus. In this case, it is advisable that attachments are disposed on both sides of the casing 3 in the horizontal direction in an uniaxial arrangement, and this attachment is held at its horizontally outer side by a support frame. In this way, the casing 3 can be mounted on the front side of the chair-type massage apparatus for free back-and-forth rocking motion.

The to-be-treated area is not limited to the lower leg L. For example, the massage apparatus is adapted for an arm massage.

EXPLANATION OF REFERENCE NUMERALS AND SYMBOLS

1 massage apparatus
2 cut-out portion
3 casing
7 massage section
8 kneading mechanism
9 rotary shaft (lower rotary shaft)
10 rotary shaft (upper rotary shaft)
11 driving section
12 changer section (lower changer section)
13 changer section (upper changer section)
14 breadth adjustment mechanism
15 stationary massage member
16 movable massage member
16A lower movable body
16B upper movable body
17 breadth adjustment rotary shaft
18 pressing projection
20 electric motor
21 speed reducer
22 speed reducer
23 gear mechanism
26 shaft bearing portion
27 shaft bearing portion
30 support member
35 rotary boss portion
36 housing portion
36 member
37 restraining portion
38 shaft hole
39 endless track
42 engagement projection
43 slide groove
50 rotation keeping bracket
51 operation dial
52 arrow
53 pull
55 external thread portion
57 indicator member
58 pointer
59 confirmation window
60 threadedly engagement portion
61 support member
L lower leg
La foot
Lb calf

The invention claimed is:

1. A massage apparatus comprising:

a pair of massage sections each having a stationary massage member and a movable massage member arranged so as to hold a to-be-treated body area in sandwich style;

a rotary shaft disposed so as to pass through a base end of the movable massage member of said massage sections;

a driving section for rotatably driving said rotary shaft;

a pair of right-hand and left-hand changer sections for changing a rotational force exerted by said rotary shaft into an action of movement of the movable massage member toward and away from said stationary massage member; and a breadth adjustment mechanism capable of positioning movement of said stationary massage member in directions toward and away from the movable massage member.

2. The massage apparatus according to claim 1, wherein said pair of said massage sections are arranged side by side in a horizontal direction, wherein said breadth adjustment mechanism includes a breadth adjustment rotary shaft which is placed with its axis pointing in the horizontal direction and is free to rotate forward and backward, said breadth adjustment rotary shaft passing through the stationary massage member mounted in the right-hand massage section and the stationary massage member mounted in the left-hand massage section while threadedly engaging each of threadedly engagement portions disposed in the stationary massage members, respectively, and wherein, in terms of screw threading, there is an inverse relationship between the threadedly engagement portion of the stationary massage member disposed in the right-hand massage section and the threadedly engagement portion of the stationary massage member disposed in the left-hand massage section.

3. The massage apparatus according to claim 2, wherein said stationary massage member is provided with an indicator member for indicating the amounts of travel toward and away from the movable massage member.

4. The massage apparatus according to claim 3, wherein a support member is disposed between said stationary massage member and said movable massage member so as to be situated at the side of the base ends of the massage members, for supporting the to-be-treated area, the support member being placed out of a range of positioning movement of the stationary massage member, yet placed near the positioning movement range.

5. The massage apparatus according to claim 4, wherein said rotary shaft passes through the stationary massage member and is retained for free rotation relative to the stationary massage member.

6. The massage apparatus according to claim 5, wherein said pair of said massage sections are arranged side by side in the horizontal direction, and wherein, in said paired right-hand and left-hand massage sections, their stationary massage members are arranged on a horizontally inward side of the apparatus, whereas their movable massage members are arranged on a horizontally outward side of the apparatus.

7. The massage apparatus according to claim 6, wherein said stationary massage member and said movable massage member are each made of a plate material which is elastically deformable in a thickness-wise direction.

8. The massage apparatus according to claim 7, wherein said to-be-treated area is defined as a lower leg including a foot and a calf, and wherein said movable massage member is composed of separate components, namely a lower movable body placed in a position for massaging the foot and an upper movable body placed above the lower movable body for massaging the calf.

9. The massage apparatus according to claim 8, wherein said stationary massage member is formed in one-piece structure having a size large enough to put pressure on the lower leg between the foot and calf regions.

10. The massage apparatus according to claim 2, wherein the breadth adjustment rotary shaft of said breadth adjustment mechanism is constructed of a unitary shaft body.

11. The massage apparatus according to claim 1, wherein said changer section comprises:

a rotary boss portion which is secured to an axial midpoint of the rotary shaft and has formed in its periphery of the rotary boss portion an endless cam face inclined to the rotary shaft;

a housing portion formed in a pierced area of said movable massage member so as to be fitted slidably in the periphery of the rotary boss portion; and a restraining portion for restraining the housing portion from rotating dependently with a rotation of said rotary boss portion.

* * * * *